US005392087A

United States Patent [19]

Wernicke

[11] Patent Number: 5,392,087

[45] Date of Patent: Feb. 21, 1995

[54] APPARATUS FOR PROCESSING PHOTOGRAPHIC MATERIALS

[75] Inventor: Ubbo Wernicke, Roesrath-Kleineichen, Germany

[73] Assignee: Agfa - Gevaert AG, Leverkusen, Germany

[21] Appl. No.: 120,799

[22] Filed: Sep. 15, 1993

[30] Foreign Application Priority Data

Sep. 23, 1992 [DE] Germany ..... 4231775

[51] Int. Cl.[6] ..... G03D 3/08

[52] U.S. Cl. ..... 354/319; 354/328

[58] Field of Search ..... 354/318–323, 354/325, 324, 328; 134/64 P, 122 P, 122 R, 64 R; 430/398, 399, 400

[56] References Cited

U.S. PATENT DOCUMENTS

| | | | |
|---|---|---|---|
| 3,277,810 | 10/1966 | Hersch | 95/94 |
| 3,728,954 | 4/1973 | Everett et al. | 95/94 R |
| 4,324,479 | 4/1982 | Sachs | 354/319 |
| 4,864,354 | 9/1989 | Crasnianski | 354/322 X |
| 5,110,713 | 5/1992 | Yoshida et al. | 430/399 |
| 5,244,776 | 9/1993 | Kawai | 430/399 |
| 5,252,439 | 10/1993 | Nakamura | 430/392 |

FOREIGN PATENT DOCUMENTS

| | | | |
|---|---|---|---|
| 0346871 | 12/1980 | European Pat. Off. . | |
| 0545202 | 6/1993 | European Pat. Off. . | |
| 2602063 | 1/1988 | France . | |
| 62-231958 | 10/1987 | Japan | 354/324 |
| 62-273534 | 11/1987 | Japan | 354/323 |
| 3-188444 | 8/1991 | Japan | 354/323 |
| 1530619 | 11/1978 | United Kingdom . | |

*Primary Examiner*—D. Rutledge
*Attorney, Agent, or Firm*—Connolly & Hutz

[57] ABSTRACT

In a tank filled with a photographic processing liquid containing, below the liquid level, devices for substantially reducing or completely removing at least once the diffusion layer adhering to the interface of the photographic material, the processing time in the given bath can be reduced or the temperature of the bath lowered without any change in the photographic results.

18 Claims, 1 Drawing Sheet

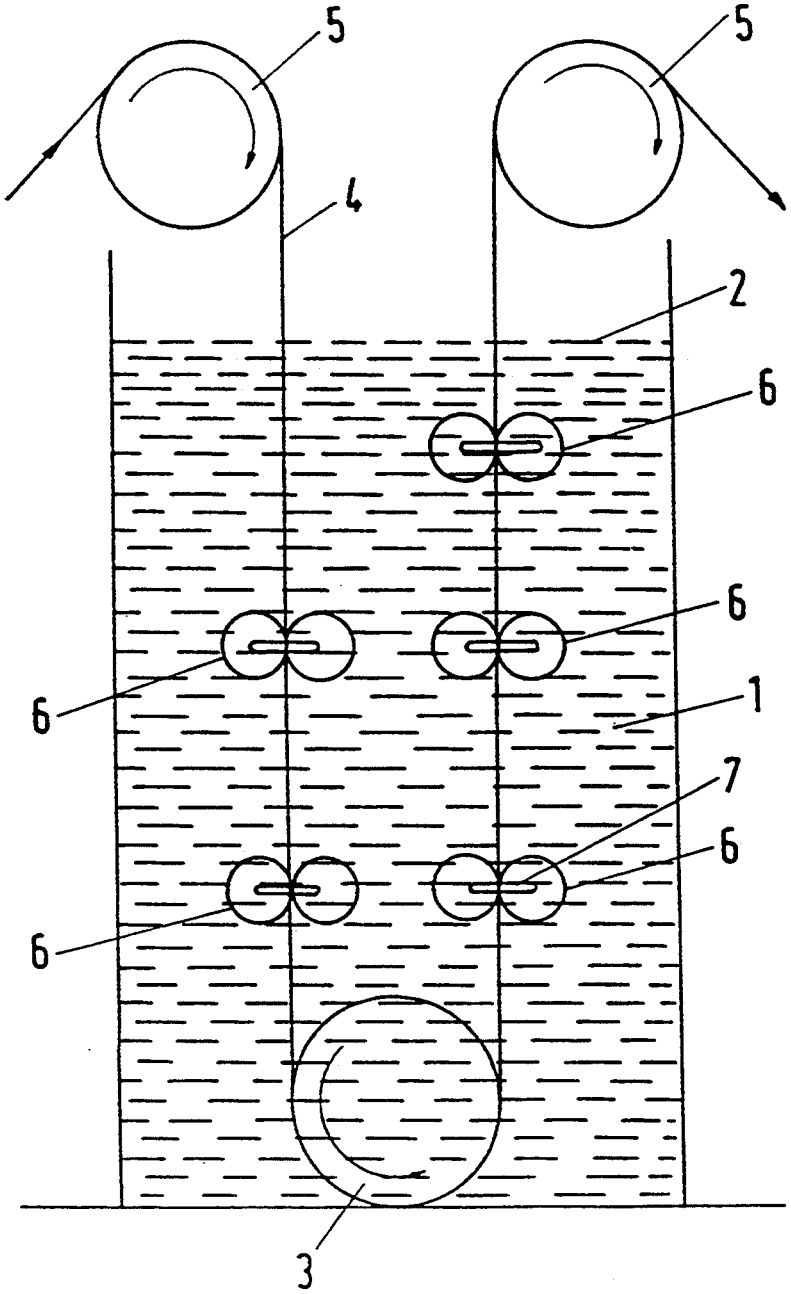
5
5
4
2
6
6
6
1
7
6
6
3

APPARATUS FOR PROCESSING PHOTOGRAPHIC MATERIALS

This invention relates to an apparatus for processing photographic materials, consisting of at least one tank filled with a processing liquid.

In the course of photographic processing, the photographic material (films/paper) passes through a multistage process, e.g. development, washing, bleaching, washing, fixing, washing, stabilization and drying or development, fixing, washing and drying.

In this process, the photographic material is carried over successive deflecting rollers through the tanks containing the various processing baths. For optimum photographic results, a minimum concentration of processing chemicals, a minimum temperature and a minimum residence time in the tank must be observed for a given size of tank.

It is desirable for economical and ecological reasons to lower the processing temperature and/or increase the speed of transport of the material and thus reduce the residence time. It may also be desirable to leave these parameters unchanged but reduce the volume of the tank. Lastly, it may be desired to alter more than one of these factors as indicated.

The problem therefore arose of finding an apparatus and a process for achieving these objects.

It is surprisingly found that this problem is solved by arranging in the particular bath, below the liquid level, at least one device with which the diffusion layer adhering to the interface of the photographic material can at least once be reduced or completely removed.

This may be realized by providing, for example, pairs of rollers or stripper lips through which or over which the photographic material travels.

The bath preferably contains at least one pair of rollers through which the photographic material is transported and the rollers of which bear against each other with a particular pressure.

The present invention thus relates to a tank filled with a photographic processing bath and containing, below the liquid level, at least one device with which the diffusion layer adhering to the interface of the photographic material is at least once substantially reduced or completely removed.

Such a device is preferably characterized in that a) several roller pairs are provided below the liquid level of the tank, b) the rollers of each pair are arranged with their axes in parallel and c) the pressure with which the rollers of at least one pair bear against each other is adjusted to from 50 to 1000 p/cm$^2$.

The axes of each pair of rollers are preferably set parallel to the horizontal.

Preferably at least 50% of the roller pairs but in particular all roller pairs fulfil the above-stated pressure condition.

Preferably at least one roller of at least one pair of rollers is driven; in particular, all roller pairs are driven.

The surface of at least one roller of each pair of rollers is preferably made of an elastic material, preferably rubber. The other roller of the pair may also be made of an elastic material or it may consist e.g. of refined steel or rigid plastic.

The invention further relates to a method of processing a photographic material in which at least one chemical solution acts on the material in a continuous treatment tank, for example a development, bleaching, fixing or bleach fixing solution, characterized in that below the liquid level of the bath, the material in the tank passes through at least one roller pair whose rollers are arranged with their axes in parallel and bear against each other with a pressure of from 50 to 1000 p/cm$^2$.

The process according to the invention is effective in particular for a photographic material whose silver halide emulsions consist to an extent of at least 80 mol-% of AgCl, preferably at least 95 mol-%.

The tank preferably contains several such roller pairs, in particular from 2 to 20 pairs, in which the rollers are arranged with their axes in parallel and bear against each other with a pressure of from 50 to 1000 p/cm$^2$.

The apparatus according to the invention is described in more detail below with reference to FIG. 1.

FIG. 1 is a side view of the apparatus according to the invention, showing the directions of movement of the roller pairs and of the photographic material.

FIG. 1 shows a chemical tank (1) within a photographic processing apparatus, e.g. a development tank, in which the liquid level is indicated at (2). The tank contains deflecting rollers (3) and (5) inside and above the liquid, and the photographic material (4) is carried over these rollers in the direction of the arrows. The tank in addition contains 5 roller pairs (6) in which the rollers of each pair are arranged with their axes in parallel and at the same level and are pressed together by tension springs (7).

EXAMPLE 1

A commercial color negative paper based predominantly on AgCl emulsions is processed in the usual manner, after imagewise exposure, by standard process RA 4/AP 94 in a processing machine comprising a development tank and bleach fixing tank shown in FIG. 1 but without the roller pairs (6):

| | | |
|---|---|---|
| Developer | 45 sec. | 35° C. |
| Bleach fixing bath | 45 sec. | 25° C. |
| Washing | 4 × 22.5 sec. | |
| Drying. | | |

The processing baths had the following composition:

a) Color developer

| | |
|---|---|
| Triethanolamine | 9.0 g/l |
| N,N-diethyl-hydroxylamine | 4.0 g/l |
| Diethylene glycol | 0.05 g/l |
| 3-Methyl-4-amino-N-ethyl-N-methane sulphonamidoethyl-aniline sulphate | 5.0 g/l |
| Potassium sulphite | 0.2 g/l |
| Triethylene glycol | 0.05 g/l |
| Potassium carbonate | 22 g/l |
| Potassium hydroxide | 0.4 g/l |
| Ethylene diaminotetracetic acid disodium salt | 2.2 g/l |
| Potassium chloride | 2.5 g/l |
| 1,2-Dihydroxybenzene-3,4,6-trisulphonic acid trisodium salt | 0.3 g/l |

made up with water to 1000 ml; pH 10.0 b) Bleach fixing bath

| | |
|---|---|
| Ammonium thiosulphate | 75 g/l |
| Sodium hydrogen sulphite | 13.5 g/l |
| Ammonium acetate | 2.0 g/l |
| Ethylene diaminotetracetic acid | |

-continued

| | |
|---|---|
| (iron-ammonium salt) | 57 g/l |
| Ammonia 25% by weight | 9.5 g/l |
| Acetic acid | 9.0 g/l |

made up with water to 1000 ml; pH 5.5.

The maximum densities obtained and the magenta and cyan side densities of the yellow field are determined as shown in Table 1 below.

EXAMPLE 2

The procedure is as in Example 1 but the development time is reduced to 25 seconds. The maximum density yellow in particular is drastically reduced.

EXAMPLE 3

(Invention)

The procedure is the same as in Example 2 but the development tank of FIG. 1 is operated with 5 roller pairs (6). Each roller pair exerts a pressure of 700 p/cm$^2$ on the material.

Result: virtually typical yellow maximum densities are obtained in spite of the development time being approximately halved.

EXAMPLE 4

The procedure is the same as in Example 1 but the time in the bleach fixing bath is reduced to 25 seconds.

Result: the copies contain considerable quantities of residual silver, which is recognizable by blackening of the yellow dye, i.e. the yellow field shows pronounced side densities in cyan and magenta under the sensitometric measurement.

EXAMPLE 5

(Invention)

The procedure is the same as in Example 4 but a bleach fixing tank shown in FIG. 1 is used, in which the rollers of the five roller pairs (6) exert each a pressure of 700 p/cm$^2$ on the material.

Result: Pure colors and no residual silver are obtained.

EXAMPLE 6

Reference

The procedure is the same as in Example 1 but the standard process with separate bleaching bath and fixing bath is employed.

| | | |
|---|---|---|
| Developer | 45 sec. | 35° C. |
| Washing | 22.5 sec. | |
| Bleaching bath | 45 sec. | 35° C. |
| Washing | 22.5 sec. | |
| Fixing bath | 45 sec. | 35° C. |
| Washing | 22.5 sec. | |
| Washing | 22.5 sec. | |

EXAMPLE 7

The procedure is the same as in Example 6 but the bleaching time is reduced to 25 sec.

Result: blackened yellow, residual silver recognizable with IR spectacles.

EXAMPLE 8

(Invention)

The procedure is the same as in Example 7 but a bleaching tank of FIG. 1 containing 5 roller pairs (6) is used in which the rollers of each pair exert a pressure of 700 p/cm$^2$ on the photographic material.

Result: pure yellow, no residual silver.

TABLE 1

| | Maximum density | | | Side density in the yellow field | |
|---|---|---|---|---|---|
| Example | Cyan | Magenta | Yellow | Cyan | Magenta |
| 1 | 2.52 | 2.40 | 2.02 | 0.21 | 0.70 |
| 2 | 2.39 | 2.27 | 1.10 | | |
| 3 | 2.49 | 2.37 | 1.98 | | |
| 4 | 2.54 | 2.46 | 2.03 | 0.43 | 0.83 |
| 5 | 2.51 | 2.39 | 2.01 | 0.22 | 0.71 |
| 6 | 2.55 | 2.42 | 2.02 | | |
| 7 | 2.57 | 2.48 | 2.05 | 0.45 | 0.85 |
| 8 | 2.54 | 2.39 | 2.01 | 0.21 | 0.69 |

I claim:

1. Apparatus for processing photographic materials, comprising at least one tank filled with a processing liquid, characterized in that a) several pairs of rollers are provided below the liquid level of the tank, b) the rollers of each pair of rollers are arranged with their axes in parallel and c) the pressure with which the rollers of at least one pair of rollers bear against each other is adjusted to from 50 to 1000 p/cm$^2$.

2. Apparatus according to claim 1, characterized in that the axes of each pair of rollers are arranged parallel to the horizontal.

3. Apparatus according to claim 1, characterized in that at least 50% of the roller pairs fulfill the pressure condition in c) of claim 1, which is from 50 to 1000 p/cm$^2$.

4. Apparatus according to claim 1, characterized in that at least one roller of the at least one pair of rollers is driven.

5. The apparatus according to claim 4, wherein all roller pairs are driven.

6. Apparatus according to claim 1, characterized in that the surface of at least one roller of each pair of rollers is made of an elastic material.

7. The apparatus according to claim 6, wherein said elastic material is rubber.

8. The apparatus according to claim 6, wherein the other roller of the pair is made of an elastic material or of refined steel or rigid plastic.

9. The apparatus as claimed in claim 1, wherein the rollers of which pair are arranged with their axes parallel to one another and bear against each other with a pressure of from 700 to 1000 p/cm$^2$.

10. The apparatus as claimed in claim 1, wherein the rollers of which pair are arranged with their axes parallel to one another and bear against each other with a pressure of from 50 to 700 p/cm$^2$.

11. The apparatus as claimed in claim 2, wherein the tank contains 2 to 20 pairs of rollers.

12. A method of processing a photographic material in which at least one chemical solution acts on the material in a continuous treatment tank, characterized in that the diffusion layer adhering to the interface of the photographic material below the liquid level of the chemical solution is at least once substantially reduced or completely removed wherein silver halide emulsions of the photographic material consist of silver chloride to an extent of at least 80 mol-%.

13. A method according to claim 12, characterized in that the reduction or removal of the diffusion layer adhering to the interface of the photographic material is brought about by passage of the material in the tank through at least one pair of rollers below the liquid level of the bath, the rollers of which pair are arranged with their axes parallel to one another and bear against each other with a pressure of from 50 to 1000 p/cm$^2$.

14. The method as claimed in claim 13 wherein the tank contains 2 to 20 pairs of rollers.

15. The method as claimed in claim 13, wherein the tank contains 5 roller pairs.

16. The method as claimed in claim 13, wherein the rollers of which pair are arranged with their axes parallel to one another and bear against each other with a pressure of from 700 to 1000 p/cm$^2$.

17. The method as claimed in claim 13, wherein the rollers of which pair are arranged with their axes parallel to one another and bear against each other with a pressure of from 50 to 700 p/cm$^2$.

18. The method according to claim 13 wherein the silver halide emulsions of the photographic material consists of silver chloride to an extent of at least 95 mol %.

* * * * *